US005601851A

United States Patent [19]

Terakawa

[11] Patent Number: 5,601,851

[45] Date of Patent: Feb. 11, 1997

[54] MELT-BLOW SPINNERET DEVICE

[75] Inventor: Taiju Terakawa, Shiga-ken, Japan

[73] Assignee: Chisso Corporation, Osaka-fu, Japan

[21] Appl. No.: 623,980

[22] Filed: Mar. 28, 1996

Related U.S. Application Data

[63] Continuation of Ser. No. 316,328, Sep. 19, 1994, abandoned.

[30] Foreign Application Priority Data

Oct. 4, 1993 [JP] Japan ..... 5-271327

[51] Int. Cl.[6] ..... B29C 47/04; B29C 47/30

[52] U.S. Cl. ..... 425/72.2; 425/131.5; 425/133.1; 425/192 S; 425/DIG. 217

[58] Field of Search ..... 425/131.5, 133.1, 425/72.2, 192 S, DIG. 217

[56] References Cited

U.S. PATENT DOCUMENTS 3,540,077 11/1970 Nakagawa et al. ..... 425/DIG. 217
3,981,650 9/1976 Page .
4,547,420 10/1985 Krueger et al. .
5,225,014 7/1993 Ogata et al. .

FOREIGN PATENT DOCUMENTS 561612 9/1993 European Pat. Off. .
2-289107 11/1990 Japan .
5-263307 10/1993 Japan .

*Primary Examiner*—Khanh P. Nguyen
*Attorney, Agent, or Firm*—Fay, Sharpe, Beall, Fagan, Minnich & McKee

[57] ABSTRACT

A combined filament type, melt-blow spinneret device can correspond to various kinds of microfine, combined filaments, and includes a spinning-resin-feeding plate 2 having respective resin-introducing grooves 7*a*, 7*b* for introducing two kinds of spinning resins A and B; a distributing plate 3 having distributing grooves 9*a*, 9*b* for respectively distributing the spinning resins A, B fed from the resin-introducing grooves of the resin-feeding plate 2; a nozzle plate 5 having a cavity 22 for receiving a separating plate 4 therein and a plurality of holes formed in a bottom interior surface of a downwardly-extending portion of the nozzle plate 5; a separating plate 4 received in the cavity 22 and attached to the second major surface of the distributing plate 3, the separating plate 4 including separation grooves 17*a*, 17*b* engraved from a side portion to a bottom portion thereof facing a plurality of holes 14 of the nozzle plate 5, for introducing the different spinning resins into the plurality of holes; and a clearance-defining plate 6 having a V-shaped groove arranged to provide a gas-introducing clearance 16 between the nozzle plate 5 and the clearance-defining plate 6 for stretching the combined resins.

13 Claims, 4 Drawing Sheets

MELT-BLOW SPINNERET DEVICE

This is a continuation application of Ser. No. 08/316,328, filed Sep. 30, 1994 now abandoned.

BACKGROUND OF THE INVENTION

1. Field of the Invention

This invention relates to a melt-blow spinneret device. More particularly, it relates to a combined filament type, melt-blow spinneret device wherein different spinning resins are respectively and separately extruded through different spinning nozzles, followed by subjecting the extruded unstretched filaments to melt-blow spinning by a high-speed gas current. By means of the melt-blow spinneret device of the present invention, microfine combined filaments are processed into a web, non-woven fabric or molded product to be used for a mask, filter for precision filtration, battery separator, hygienic material, heat insulator, etc.

2. Description of the Related Art

The so-called melt-blow spinning wherein a thermoplastic synthetic resin is extruded through spinning nozzle plates, accompanied by spouting a high speed gas onto the extruded unstretched filaments through clearances provided on both the sides of the spinning nozzle plate, can afford microfine filaments having a diameter of e.g. 10 μm or less, and also makes it possible to continuously carry out spinning and production of non-woven fabric. Hence, the above spinning is an advantageous process for producing a non-woven fabric of microfine filaments.

In recent years, a process of subjecting two different kinds of polymers to conjugate melt-blow spinning, a process of subjecting them to combined filaments type melt-blow spinning, and the like have been proposed.

As to the so-called conjugate melt-blow spinning, Japanese patent application laid-open Nos. Sho 60-99057 and Sho 60-99058 disclose a side-by-side type, conjugate melt-blow spinneret device provided with conduits for introducing two kinds of polymers from the respective extruders, into holes connected to the conduits for combining conjugate components, and an air orifice, and a spinning process using the device. These patent applications disclose that it is possible to produce microfine filaments according to a side-by-side type conjugate melt-blow spinning process, in combinations of various heterogeneous polymers such as polypropylene/polyester, polypropylene/nylon-6, etc.

In the case of the spinneret device and the production process of conjugate filaments disclosed in the above patent applications, the objective microfine filaments can be obtained by controlling the temperature, the retention time of polymers inside the extruders, the polymer compositions, etc. so that the viscosities of polymers at the time of passing through the die can be similar. However, a production of uniform conjugate filaments is possible only in the case where control of the temperature, the retention time, inside high precision extruders, the polymer compositions, etc. are possible, the retention time of polymers inside the die is short, and a die of a relatively small type is provided, without taking productivity into consideration.

Japanese patent application laid-open No. Hei 4-370210 discloses a combined filament type, melt-blow spinneret device wherein divided rooms of a first resin reservoir and a second resin reservoir are provided, and a first spinning nozzle and a second spinning nozzle obliquely bored from the bottom parts of the rooms toward tapered tip ends of the nozzles, for leading the respective spinning resins are provided. In the case of this device, the tip end width of the nozzles is specified, whereby the obliquely spun filaments are perpendicularly turned by the time of the contact of the filaments with a high speed gas current, followed by contacting with the gas current in a state where molted resins have been somewhat solidified. Hence, combined filaments spinning is possible without any fiber breakage or shot.

However, according to such a conventional device, the spinning direction of the filaments is persistently oblique, and contact of the filaments in the molten state just below the tip end of the nozzle piece, with the accompanying gas current, generated by the high speed gas current is asymmetric. Thus, a turbulent gas flow is liable to occur at the tip end part of the nozzle piece. Namely, there is raised a problem that insufficient stretching due to the turbulent gas current occurs to cause blocking between filaments, resulting in occurrence of filament aggregate. In particular, as the filament-combining ratio becomes 2/1, 3/1, etc. apart from 1/1, contact of the high speed gas current with the spun filaments of the respective components becomes non-uniform and irregular to cause blocking between the filaments of the same kind or different kinds, whereby a large quantity of filament aggregate is liable to occur.

Further, conventional apparatuses are effective only in the case where they are provided so as to carry out blow spinning in the vertical direction. Hence, the apparatuses have a drawback that the above-mentioned phenomenon becomes more notable in the case where they are provided so as to carry out blow spinning in the oblique or lateral direction.

Further, according to conventional devices, since spinning nozzles are obliquely bored in one nozzle plate block, the length of the spinning nozzles cannot help becoming larger than that of spinning nozzles bored in the vertical direction, whereby it is difficult to bore spinning nozzles with good precision and cheaply. Still further, in the case of the above devices, when they are reassembled and reused after burning, ultrasonic washing, etc. after spinning, the spinning nozzles are so long in the length direction that removal of extraneous matter adhered onto the wall thereof is liable to be insufficient, resulting in extrusion unevenness and extrusion of spiral filaments at the respective spinning nozzles, to make it difficult to spin uniform filaments. In order to solve such problems, if the spinning nozzles are shortened, the resin pressure exerted onto the spinning nozzles lowers, so that this cannot correspond to a combination of heterogeneous polymers in a broad range wherein the viscosity and the physical properties are varied. Further, there are dangers that distortion or cracks occur at the tip end part of the nozzle plate block. This becomes more notable when the nozzle plate width is broaded or the number of the spinning nozzles is increased; such a device cannot be regarded as a device taking productivity into account.

Further, according to the conventional devices, when the combining proportions of the respective components is changed, a plural number of nozzle plates corresponding to the respective combining proportions are required. Hence, a problem has been raised that an expensive device should be indispensably employed.

SUMMARY OF THE INVENTION

An object of the present invention is to provide a combined filament type melt-blow spinneret device which can correspond to a broad range of combinations of heterogeneous polymers having different viscosities and physical properties, and yet which can produce filaments having few filament aggregates and little filament unevenness.

Another object of the present invention is to provide a melt-blow spinneret device which can correspond to optional filament-combining proportions of heterogeneous polymers, without exchanging an expensive nozzle plate, but by exchanging only a cheap separating plate when the proportions are changed, and wherein the inner cavity of the nozzle plate, the separating plate, etc. are hardly damaged.

Still another object of the present invention is to provide a melt-blow spinneret device having a nozzle plate of a broad width in the length direction and superior productivity.

Further, still another object of the present invention is to provide a device which can carry out blow-spinning not only in the vertical direction, but also in an optional direction.

The term "filaments" as used hereinafter is intended to include filaments and fibers.

BRIEF DESCRIPTION OF THE DRAWINGS OF THE INVENTION

1: combined filaments type spinneret device for melt-blow spinning, 2: spinning-melted-resin-feeding plate, 3: distributing plate, 4: separating plate, 5: nozzle plate, 6: clearance-defining plate, 7*a*: groove for introducing spinning melted resin of component A, 7*b*: groove for introducing spinning melted resin of component B, 8*a*: hole for distributing the component A, 8*b*: hole for distributing the component B, 9*a*: groove for distributing the component A, 9*b*: groove for distributing the component B, 10: filter, 11: bolt, 12: groove for controlling the pressure of spinning melted resins, 13: groove for receiving the spinning melted resins, 14: spinning resin-introducing hole, 15: spinning nozzle, 16: clearance for gas spouting, 17*a*: groove for separating the component A, 17*b*: groove for separating the component B, 18: gas-introducing port, 19: separating portion wall, 20: top part of separating plate, 21: abutted face of separating plate, 22: inner cavity of nozzle plate, 23: A component filament, 24: B component filament, 25: partly conjugated filament, D1: narrow clearance between the bottom surface K of separating plate and the bottom surface X of nozzle plate, D2: depth of separating groove, W1: width of separating groove, W2: diameter of spinning resin-introducing hole, W3: narrow clearance between the nearly V-form side surface M of separating plate and the nearly V-form inner surface Y of nozzle plate, M: the nearly V-form side surface of the lower part of separating plate, Y: the nearly V-form inner surface of the lower part of nozzle plate, and K: bottom surface of separating plate.

DESCRIPTION OF PREFERRED EMBODIMENTS

The embodiments of the present invention will be described below referring to the accompanying drawings.

Figure 1:
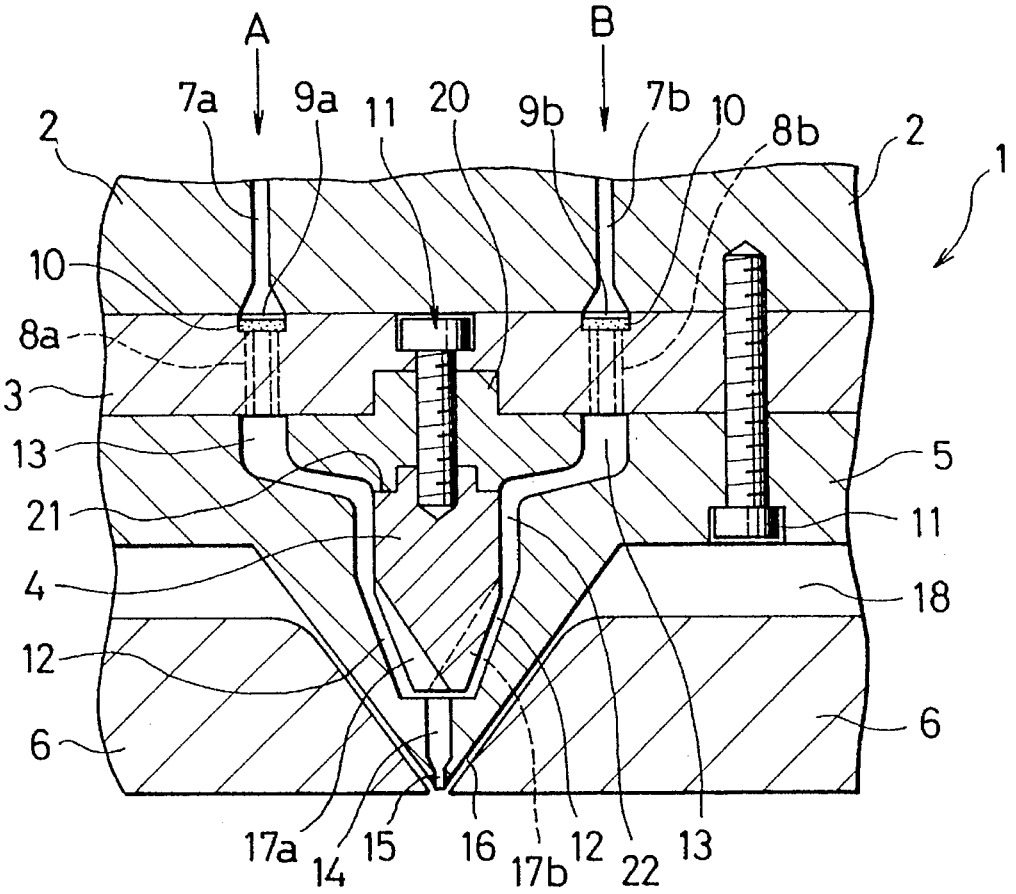
FIG. 1 shows a front, schematic, cross-sectional view of a spinneret device for conjugate melt-blow spinning.
Figure 2:
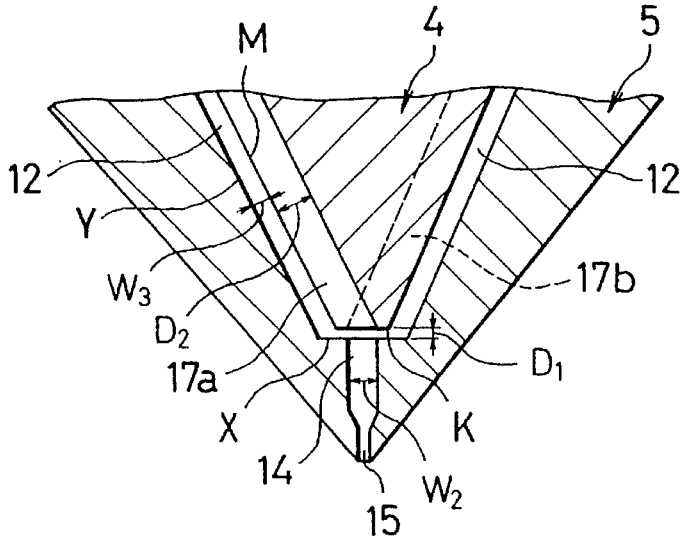
FIG. 2 shows an enlarged, cross-sectional view of the lower part of the nozzle plate of FIG. 1.

FIG. 1 shows the front schematic cross-sectional view of the spinneret device for melt-blow spinning, and FIG. 2 shows the enlarged cross-sectional view of the lower part of the nozzle plate of FIG. 1.

This spinneret device is mainly composed of a spinning-resin-feeding plate 2 having respective resin-introducing grooves 7*a*, 7*b* for introducing two kinds of spinning resins A and B;

a distributing plate 3 attached to the spinning-resin-feeding plate 2 and having a first major surface abutting a major surface of the spinning-resin-feeding plate 2, the distributing plate 3 having distributing grooves 9*a*, 9*b* for respectively distributing the spinning resins A, B fed from the resin-introducing grooves of the resin-feeding plate 2;

a nozzle plate 5 fixed to the distributing plate 3 and having a first surface abutting a second major surface of the distributing plate 3, the nozzle plate 5 having a cavity 22 for receiving a separating plate 4 therein and a plurality of holes 14 formed in a bottom interior surface of a downwardly-extending portion of the nozzle plate 5, the holes 14 opening towards the cavity and respectively communicating with a like plurality of spinning nozzles 15 formed in the downwardly-extending portion of the nozzle plate 5, the spinning nozzles opening away from the cavity;

a separating plate 4 received in the cavity 22 and attached to the second major surface of the distributing plate 3, the separating plate 4 having a lower part of the nearly V-form cross-section and having separation grooves 17*a*, 17*b* engraved from both the side portions to a bottom portion of the lower part, facing the plurality of holes 14 of the nozzle plate 5, for introducing the different spinning resins into the plurality of holes; and a clearance-defining plate 6 having a V-shaped groove for receiving the downwardly-extending portion of the nozzle plate 5 therein, the clearance-defining plate 6 being arranged to provide a gas-introducing clearance 16 between the nozzle plate 5 and the clearance-defining plate 6 for stretching the combined resins using the introduced gas as the combined resins emerge from the spinning nozzles 15.

The combined filament type, melt-blow spinneret device 1 of the present invention is composed mainly of a nozzle plate 5 having an inner cavity 22 engraved therein and a spinning-resin-introducing hole 14 and a spinning nozzle 15 bored successively at the bottom surface X of the inner cavity 22; a separating plate 4 for separating the respective spinning resins and leading them into the above spinning-resin-introducing hole 14, and a clearance 16 for spouting a gas, formed toward the exit of the spinning nozzle 15.

The diameter of the spinning-resin-introducing hole 14 may be the same as that of the spinning nozzle 15.

The separating plate 4 and the nozzle plate 5 are fixed by bolts 11, to a spinning-resin-feeding device 2 separately feeding two kinds of spinning resin onto the spinning-resin-feeding side of the nozzle plate 5.

The spinning-resin-feeding device is, for example, composed of a spinning-resin-feeding plate 2 having resin-introducing grooves 7*a*, 7*b* having spinning resins A and B respectively supplied thereinto, engraved therein, and a distributing plate 3 for uniformly distributing the spinning resins A and B fed via the spinning-resin-feeding plate 2.

The grooves 7*a*, 7*b* are engraved in a groove-form in the spinning-resin-feeding plate 2, and the discharge ports are broadened toward the end and made so as to accord with the distributing grooves 13 of the distributing plate 3.

The spinning-resin-feeding plate 2 may be an integral material, but in the case of this figure, it is divided into a left member, a central member, and a right member on the drawing, which are fixed with bolts (not shown).

The distributing plate 3 has distributing grooves 9*a*, 9*b* engraved in the length direction, that is, in the front and rear directions with reference to FIG. 1. Further, a number of distributing holes 8*a*, 8*b* are bored at the bottoms of the distributing grooves 9*a*, 9*b*. The distributing grooves 9*a*, 9*b* are fitted with filters 10, and the bottoms thereof also function as members for supporting the filters. The filters may be provided on the spinning-resin-discharge ports of the distributing plate 3 or on the spinning-resin-discharge port of the spinning-resin-feeding plate 2.

The inner cavity of the nozzle plate 5 is divided by the separating plate 4 arranged in the inner cavity into a left part and a right part in the drawing, to form two spinning-resin-receiving grooves 13 and narrow clearances D2 and D1 (FIG.2) on the side surface in the vicinity of the lower parts of the grooves 12 and at the bottom part of the inner cavity, respectively.

On the upper surface of the nozzle plate 5, an inner cavity is engraved in the length direction, that is, in the front and rear directions with reference to FIG. 1, and on the bottom surface X of the inner cavity, a resin-introducing hole 14 and a spinning nozzle 15 are bored successively so that the respective central axes thereof can accord with each other.

The clearance-defining plate 6 is preferably made of two half members provided under the downwardly-extending portion of the nozzle plate 5 as shown in FIG. 1.

In the above constitution, the respective spinning resins of component A and component B melt-extruded through two extruders are sent to the respective spinning-resin-receiving ports by means of two gear pumps (not shown), and discharged into the distributing grooves 9*a*, 9*b* of the distributing plate 3 via the respective spinning-resin-introducing grooves 7*a*, 7*b*. The respective spinning resins pass through the respective spinning-resin-receiving grooves 13 and the left and right separating grooves 17*a*, 17*b* of the separating plate 4, further pass through the resin-introducing holes 14 and are spun through spinning nozzles 15. Separating grooves 17*a*, 17*b* may be engraved only on the bottom surface of the separating plate 4 and a separating partition wall may be formed, and further they may be engraved from the side surface to the bottom surface of the separating plate 4. The widths of the separating grooves 17*a*, 17*b* may be the same as the diameter of the spinning-resin-introducing hole 14, or may be broader or narrower than that, and a part of the separating grooves 17*a*, 17*b* may overlap with a part of the spinning-resin-introducing hole 14. Further, the respective spinning resins may be sufficient to be separately led into the spinning-resin-introducing hole 14.

In the spinneret device of the present invention, the bottom surface X of the inner cavity of the nozzle plate 5 is abutted onto the bottom surface K of the separating plate 4 (i.e. the separating partition wall 19. See FIGS. 3–7), or not abutted, but forms a narrow clearance D1 between them. Further, the side surface M of the radiant-shape part in the nearly V-form formed in the lower part of the separating plate 4 is abutted to the side surface Y in the nearly V-form of the lower part of the cavity of the nozzle plate 5, or not abutted, but forms a narrow clearance W3 between them. In the case where there is a clearance on the bottom surface, or both side surface or both the surfaces, the side surface and the bottom surface are not damaged at the time of constructing the spinneret device. The clearances W3 and D1 are preferred to be about 0.1 to 10 mm. If the clearances are less than 0.1 mm or they are abutted, there is a fear that the side surface and the bottom surface are injured at the time of construction of the spinneret device. Thus, sufficient caution is necessary. If the clearances exceed 10 mm, as the moving speed of the spinning resins therethrough becomes very slow, abnormal thermal decomposition or carbonization of the spinning resin, abnormal pressure fluctuation, etc. at the spinning-resin-introducing hole are liable to occur.

The diameter W2 of the spinning-resin-introducing holes 14 bored in the nozzle plate 5 is preferred to be about 0.25 to 5 mm in that the productivity is improved as the number of holes can be increased and the mixing of the respective components is prevented. The diameter of the spinning nozzles 15 is preferred to be about 0.1 to 2 mm in that microfine filaments having an even fineness can be obtained. The L/D of the spinning nozzles is preferred to be 3 or more, and it is more preferred to be 5 to 20, taking the flow-controlling effect of the spinning resin and the accuracy of bore-processing into account. The spinning nozzles are bored to about 0.5 to 10 mm. Further, the diameter of the spinning nozzles may be the same as that of the resin-introducing holes, and may have any of various kinds of odd-shaped cross-sections.

The separating plate 4 is fixed onto the distributing plate 3 at its top part 20. As to the separating plate 4, the upper part element thereof is abutted onto the lower part element through the abutted part 21 and fixed with bolt 11. The separating plate 4 has separating grooves 17*a*, 17*b* engraved from the side surface to the bottom surface thereof. There is a separating partition wall 19 between the grooves (see FIG. 3 to 7).

FIGS. 3 to 6 respectively show a schematic view illustrating the relationship between the bottom surface of the separating plate 4 and the bottom surface of the inner cavity of the nozzle plate 5. The separating grooves 17*a*, 17*b* are engraved so that the width W1 thereof can be larger than the diameter W2 of the spinning-resin-introducing holes 14. Still further, the groove is engraved so that the introducing holes 14 can be completely covered with the groove at the bottom surface of the nozzle plate 5, that is, so that the lengths in the upper and lower directions and in the left and right directions of the grooves 17*a*, 17*b* in on FIG. 3 can become larger than those of the introducing holes 14.

Figure 3:
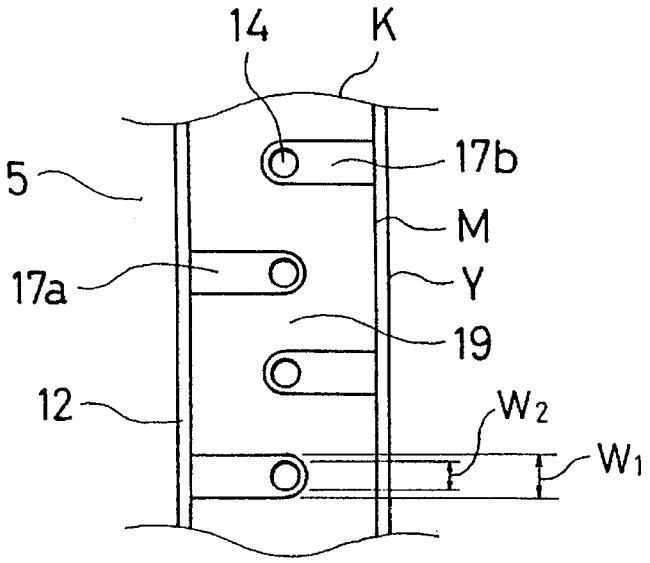
FIG. 3 shows a view illustrating the relationship between the bottom surface of the separating plate and the bottom surface of the nozzle plate (combined filaments proportion: 1/1).
Figure 4:
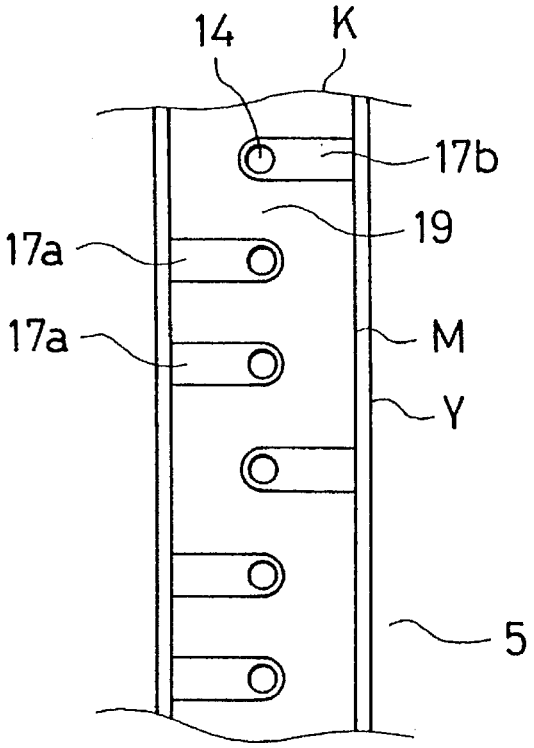
FIG. 4 shows a view illustrating the relationship between the bottom surface of the separating plate and the bottom surface of the nozzle plate (combined filaments proportion: 2/1).
Figure 5:
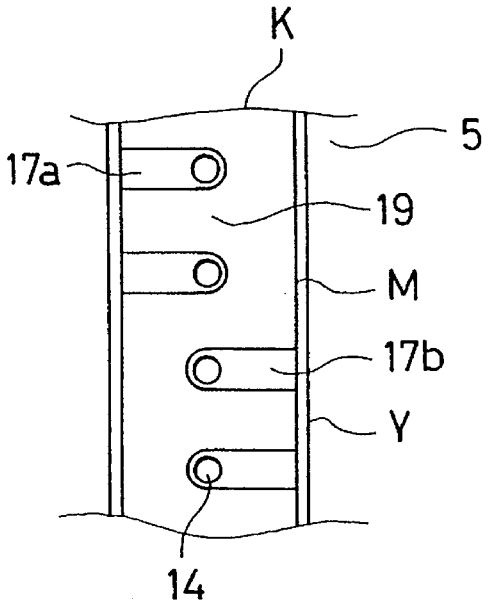
FIG. 5 shows a view illustrating the relationship between the bottom surface of the separating plate and the bottom surface of the nozzle plate (combined filaments proportion: 1/1).
Figure 6:
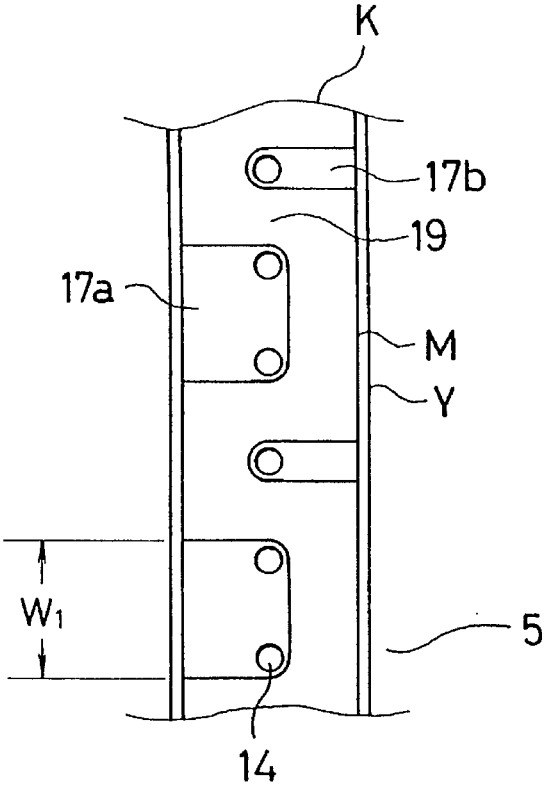
FIG. 6 shows a view illustrating the relationship between the bottom surface of the separating plate and the bottom surface of the nozzle plate (combined filaments proportion: 2/1).

As to the separating grooves 17*a*, 17*b* in the case where the combined filaments proportions is 1/1 in terms of the ratio of numbers of nozzles, the grooves are engraved alternately each in one as seen in FIG. 3, or each in two as seen in FIG. 5, or each in three or more, or each in the same or almost the same number on the left and right sides of the nearly V-form of the separating plate. Further, in the case where the proportion is 2/1, the grooves are engraved in a proportion of each in two on the left side and each in one on the right side, as seen in FIG. 4. The separating grooves may be sufficient in one per one of the resin-introducing holes 14, but the grooves may be engraved in one per two or more spinning-resin holes, as seen in FIG. 6.

Figure 7:
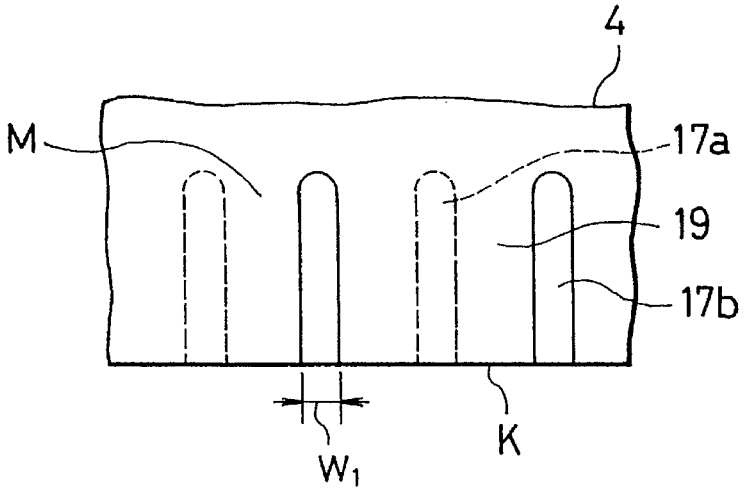
FIG. 7 illustrates a view of the side surface of the separating plate.

In the schematic view of the side surface (in the length direction) of the separating plate 4, as shown in FIG. 7, the respective separating grooves 17*a*, 17*b* are not particularly limited as to length. The grooves may be engraved only in the vicinity of the nearly V-form part of the separating plate, or may be extended onto the upper part thereof toward the spinning-resin-receiving groove. In this case, the width and depth of the grooves 17*a*, 17*b* may be changed from those on the bottom surface.

The spinning-resin-receiving grooves 13 constituted by the clearance between the outer wall of the separating plate 4 and the inner cavity wall of the nozzle plate 5 is extended in the length direction of the nozzle plate 5, and is liable to cause a pressure unevenness in the length direction of the spinning plate 4 (extrusion unevenness directed to each spinning nozzle), when the spinning resins flow down through the grooves, which may result in fineness unevenness. However, by providing the separating grooves 17*a*, 17*b*, a uniform resin pressure can be maintained, thereby preventing occurrence of fineness unevenness.

The widths W1 of the separating grooves are preferably about 0.26 to 10 mm. In the case where one separating groove per two or more spinning-resin-introducing holes is engraved, the width may be one in which the resin-introducing hole is completely covered, that is, 10 mm or more.

The depth D2 of the separating grooves is preferably about 0.1 to 10 mm, and more preferably about 0.2 to 7 mm. When such a range is given, the spinning resins flow through the grooves and are led to the spinning nozzles 15 at a moderate speed, whereby abnormally high speed or abnormally slow speed of the flowing resins is prevented, to prevent abnormal thermal decomposition, etc. of the resins.

Further, the grooves 17 may be different in the depth, on the left side and the right side of the nearly V-form or/and at the upper part and the lower part thereof. For example, in the case where a polymer having a relatively high viscosity is used, it is preferable to engrave the grooves deeply on the side thereof where it is introduced, and to the contrary in the case where a polymer having a low viscosity is led, it is preferable to engrave the grooves shallowly on the side thereof where it is introduced.

The separating partition-wall 19 provided between the respective separating grooves 17*a*, 17*b* of the separating plate 4, when the respective bottom surfaces are abutted to the bottom surface of the nozzle plate 5, completely prevents the mixing of the polymers of the component A and the component B with each other, to effect a combined filament type, melt-blow spinning of two different kinds of resins with each other. Further, even in the case where there is a narrow clearance D1, if the clearance is relatively small, combined filaments of single components wherein the respective polymers are not mixed with each other as described above are obtained. However, in the case where the clearance D1 is relatively large, there are obtained combined filaments forming side- by-side, conjugate filaments wherein the respective polymers led from the right side and the left side are alternately different in the component ratio, in the vicinity of the spinning-resin-introducing holes 14 at the bottom surface.

Further, when the width and depth of the separating grooves 17*a*, 17*b* and the clearance between the outer wall of the separating plate 4 and the inner cavity of the nozzle plate 5 are set to optional sizes in the length direction, it is possible to obtain optional combined filaments such as those of single component filaments or those of side- by-side type, conjugate filaments having different conjugate proportions of two components, those of side-by-side type, conjugate filaments having a small conjugate proportion of two components, with side-by-side type, conjugate filaments having a large conjugate proportion of two components.

As to the separating plate, it is very easy to engrave the groove 17, as compared with hole processing, and the plate can be prepared at a cheap cost. Thus, when several separating plates having a different number or width of separating grooves on the left and right side of the nearly V-form thereof are provided, it is possible to easily prepare microfine filaments having no fineness unevenness, filament aggregate, etc. even in the case of preparation of filaments having different filament-combining proportions and polymers having different viscosity, etc., and only by way of exchanging the separating plates.

The gas-spouting clearance 16 is formed between a clearance-defining plate 6 provided around the nozzle plate 5, and the nozzle plate 5. Unstretched filaments extruded through spinning nozzles 5 are blown by spouting a high temperature and high pressure gas led through a gas introducing-port 18 through a gas-spouting clearance 16, and collected in the form of a microfine filament web by means of a collecting device provided under the spinning nozzle plate. As the spouting gas, an inert gas such as air, nitrogen gas, etc. is used, the temperature and the pressure of the gas is about 100° to 500° C. and about 0.1 to 6 $Kg/cm^2$.

Figure 8A:
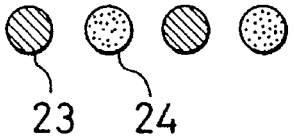
FIG. 8A shows combined microfine filaments of single component filaments with each other.
Figure 8B:
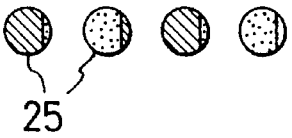
FIG. 8B shows combined microfine filaments of single component filaments with side-by-side conjugate filaments having different component proportions.
Figure 8C:
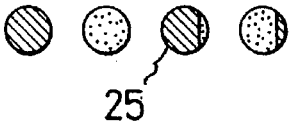
FIG. 8C shows combined microfine filaments of single component filaments with partly conjugated filaments.

The cross-section of the combined filaments obtained according to the device of the present invention is schematically illustrated by FIGS. 8A, 8B and 8C. FIG. 8A illustrates microfine filaments wherein A component filament 23 has been completely separated from B component filament 24, which includes the case where the bottom surface of the separating plate 4 is abutted on the bottom surface of the inner cavity of the nozzle plate, as well as the case where there is a relatively narrow clearance D1 between the above surfaces. The resulting combined filaments are those obtained by preventing mixing of the respective polymers led from the left side and the right side of the nearly V-form in the vicinity of the inlets of the resin-introducing holes 14.

FIG. 8B shows combined, microfine filaments of side-by-side type conjugate filaments different in the conjugate ratio of A component/B component. The combined filaments are obtained by using the separating plate having the separating grooves alternately engraved on both sides of the nearly V-form so as to give the same size of the width or/and the depth of the grooves in the length direction and in the width directions, providing a relatively large size to the narrow clearance D1 and using polymers having a relatively small viscosity difference.

FIG. 8C illustrates combined microfine filaments of two kinds of single component filaments with side-by-side type conjugate filaments having different conjugate proportions of A component/B component. The combined filaments are obtained by using the separating plate having the separating grooves alternately engraved in the length direction so as to give optionally different size(s) to the width or/and the depth of the grooves, making the size of the narrow clearance D1 intermediate one between those in the cases of FIG. 8A and FIG. 8B, and using polymers having a relatively small viscosity difference. In addition, in the case where the viscosity difference is relatively large, conjugate filaments, either one of which are in the form of a half moon, are obtained.

Further, according to the melt-blow spinneret device of the present invention, spinning may be carried out not only in the vertical direction, but also in an optional direction such as in the horizontal direction.

The filaments obtained by the device of the present invention may be used as they are, or for various applications, such as web, non-woven fabric, etc., by subjecting them to modification treatment such as corona discharge treatment, hydrophylic treatment, treatment with an antibacterial agent, by blending or laminating other filaments, or melt-adhering at least one of the component filaments by heating.

Effectiveness of the Present Invention

As the melt-blow spinneret device of the present invention is provided with a nozzle plate and a separating plate for combined filaments, which is easily removable, it is possible to easily obtain optional microfine, combined filaments corresponding to use applications. Further, even when the viscosity, the spinning temperature, etc. are varied to some extent, it is possible to choose a device having an optimum flow-adjusting function; thus it is possible to obtain microfine, stable combined filaments having little fineness unevenness, and also it is possible to correspond to a broad range of combined filament type, melt-blow spinning of various kinds of spinning resins in an optional ratio of combined filaments. Further, it is unnecessary to manufacture the conventional expensive nozzle plate, but it is sufficient to exchange only the separating plate for various kinds of combined filaments. Further, width a separating plate which can be divided into an upper member and a lower member, manufacture of a spinneret device is easier and cheaper.

Since the nozzle plate affords stabilized spinning and its manufacture is easy, many spinning nozzles can be bored, and the width of the plate can be increased; hence a device having a high productivity can be provided.

In the case of a device wherein the separating plate and the nozzle plate are arranged so as to have narrow clearances at the bottom surface and the side surface, neither the nozzle plate nor the separating plate is subject to damage, but they can be repeatedly used for a long time.

What we claim is:

1. A pinneret device for producing combined filaments consisting of different kinds of single component filaments by melt-blow spinning, comprising:

a spinning-resin-feeding plate having respective spinning-resin-introducing grooves for introducing two kinds of spinning resins;

a distributing plate attached to the spinning-resin-feeding plate and having a first major surface abutting a major surface of the spinning-resin-feeding plate, said distributing plate having distributing grooves for respectively distributing the spinning-resins fed from the spinning-resin-introducing grooves of the spinning-resin-feeding plate;

a nozzle plate fixed to the distributing plate and having a first surface abutting a second major surface of the distributing plate, said nozzle plate having a cavity and a plurality of spinning-resin-introducing holes formed in a bottom interior surface of a downwardly-extending portion of the nozzle plate, said spinning-resin-introducing holes opening towards the cavity and respectively communicating with a plurality of spinning nozzles formed in the tip portion of the nozzle plate, said spinning nozzles opening away from the spinning-resin-introducing holes;

a separating plate in the cavity and attached to the second major surface of the distributing plate, said separating plate having a lower part and having separating grooves engraved from side portions of the separating plate to a bottom portion of said lower part, facing the plurality of spinning-resin-introducing holes of the nozzle plate, for introducing the different spinning resins into the plurality of spinning-resin-introducing holes, wherein said separating plate is divided into an upper member and a lower member, said lower member being attached to said upper member detachably, the side surface and a bottom surface of the bottom portion of said lower member being provided with said separating grooves said bottom surface of the separating plate being elongated, and at least one of said separating grooves for receiving one of the spinning resins and at least one other of said separating grooves for receiving another of the spinning resins are shifted with respect to each other on the bottom surface of the separating plate in a lengthwise direction thereof; and a clearance-defining plate having a V-shaped groove for receiving the downwardly-extending portion of the nozzle plate therein, said clearance-defining plate being arranged to provide a gas-introducing clearance between the nozzle plate and the clearance-defining plate for stretching the combined resins using the introduced gas as the combined resins emerge from the spinning nozzles.

2. A spinneret device according to claim 1, wherein the respective diameters of said plurality of spinning-resin-introducing holes are the same as those of said spinning nozzles.

3. A spinneret device according to claim 1, wherein said separating grooves engraved on the bottom surface of said separating plate have a width broader than the diameter of the spinning-resin-introducing holes.

4. A spinneret device according to claim 1, wherein said separating grooves engraved on the bottom surface of the separating plate have a width enough to cover two or more of said spinning-resin-introducing holes.

5. A spinneret device according to claim 1, wherein at least one of said separating grooves has one of a different width and a different depth from at least one of the other separating grooves.

6. A spinneret device according to claim 1, wherein the bottom portion of said separating plate has a bottom surface that is abutted on a bottom surface of the cavity of said nozzle plate.

7. A spinneret device according to claim 1, wherein said separating plate is provided so that a side surface thereof is abutted on a side surface of said cavity of the nozzle plate.

8. A spinneret device according to claim 1, wherein said separating plate is provided so that a narrow clearance is provided between a bottom surface thereof and a bottom surface of the cavity of said nozzle plate.

9. A spinneret device according to claim 1, wherein said separating plate is provided so that a narrow clearance is provided between a side surface thereof and a side surface of the cavity of said nozzle plate.

10. A spinneret device according to claim 1, wherein each of the separating grooves for said one of the spinning-resins and each of the separating grooves for said another of the spinning-resins are provided alternately in said lengthwise direction of the bottom surface of the separating plate.

11. A spinneret device according to claim 1, wherein two separated, adjacent separating grooves engraved for said one of the spinning-resins and one separating groove engraved for said another of the spinning-resins are provided alternately in said lengthwise direction of the bottom surface of the separating plate.

12. A spinneret device according to claim 1, wherein a group of two separated, adjacent separating grooves engraved for said one of the spinning-resins and a group of two separated, adjacent separating grooves engraved for said another of the spinning-resins are provided alternately in said lengthwise direction of the bottom surface of the separating plate.

13. A spinneret device according to claim 1, wherein a separating groove engraved for introducing said one of the spinning-resins to two adjacent spinning-resin-introducing holes and one separating groove engraved for introducing said another of the spinning-resins to a spinning-resin-introducing hole are provided alternately in said lengthwise direction of the bottom surface of the separating plate.

* * * * *